US006725471B2

(12) United States Patent
Ferber et al.

(10) Patent No.: US 6,725,471 B2
(45) **Date of Patent: *Apr. 27, 2004**

(54) BATH APPARATUS

(75) Inventors: Roman S. Ferber, West Bloomfield, MI (US); Alex Wong Chi To, Hong Kong (HK)

(73) Assignee: HoMedics, Inc., Commerce Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/154,220

(22) Filed: May 23, 2002

(65) Prior Publication Data

US 2002/0133872 A1 Sep. 26, 2002

Related U.S. Application Data

(63) Continuation of application No. 09/759,507, filed on Jan. 13, 2001, now Pat. No. 6,393,633, which is a continuation-in-part of application No. 09/631,643, filed on Aug. 2, 2000, now Pat. No. 6,385,795.

(51) Int. Cl.[7] ..... A47K 3/022

(52) U.S. Cl. ..... 4/622; 4/541.5; 601/22; 601/154; 607/86; 607/111

(58) Field of Search ..... 4/541.1, 541.5, 4/621, 622; 601/22, 154, 158, 166; 607/86, 111

(56) References Cited

U.S. PATENT DOCUMENTS

| | | | |
|---|---|---|---|
| 5,029 | A | 3/1847 | Thatcher |
| 1,775,942 | A | 9/1930 | Millmather |
| 2,633,846 | A | 4/1953 | Wray |
| 2,736,038 | A | 2/1956 | Mansfield |
| 2,904,037 | A | 9/1959 | Cassidy |
| 3,055,357 | A | 9/1962 | Redka |
| 3,380,080 | A | 4/1968 | Farrell |
| 3,467,969 | A | 9/1969 | Szekely |
| 3,965,495 | A | 6/1976 | McNair |
| 4,057,053 | A | 11/1977 | Kunz |
| 4,184,488 | A | 1/1980 | Bielich |
| 4,497,313 | A | 2/1985 | Kurosawa |
| 4,513,735 | A | 4/1985 | Friedson et al. |
| 4,620,529 | A | 11/1986 | Kurosawa |
| 4,880,415 | A | 11/1989 | Urakami |

(List continued on next page.)

FOREIGN PATENT DOCUMENTS

| | | |
|---|---|---|
| CH | 562600 | 6/1975 |
| DE | 1 429 756 | 2/1969 |
| DE | 29 45 866 | 5/1981 |
| EP | 0 064 178 | 11/1982 |
| JP | 6339509 | 12/1994 |

OTHER PUBLICATIONS

Exhibit "A" Conair Deluxe Massaging Foot Spa (Date unknown; believed to be prior art), 1 pg.

Exhibit B: HoMedics US–2H Foot Bath, 1 Pg., no date given.

*Primary Examiner*—Robert M. Fetsuga
(74) *Attorney, Agent, or Firm*—Brooks Kushman P.C.

(57) ABSTRACT

An apparatus is provided for bathing body parts, such as the feet. The apparatus includes a bath chamber for containing fluid, such as water, and receiving the body part therein. The bath chamber includes a bottom surface and a wall structure extending upwardly therefrom. A pump is disposed adjacent to the bottom surface of the bath chamber, and a bubble egress tube is provided in communication with the pump and the bath chamber bottom surface. The bubble egress tube has a continuous configuration which traverses a surface area of the bath chamber bottom surface having a width dimension greater than the width of the egress tube. Air from the pump is directed into the bath chamber through egress holes formed in the bubble egress tube, thereby generating air bubbles in the fluid contained in the bath chamber.

42 Claims, 13 Drawing Sheets

U.S. PATENT DOCUMENTS

| | | | | |
|---|---|---|---|---|
| D330,426 | S | | 10/1992 | Elkerbout |
| D364,466 | S | | 11/1995 | Assmann et al. |
| 5,588,161 | A | | 12/1996 | Barradas |
| D390,963 | S | | 2/1998 | Scholpp |
| 5,728,051 | A | | 3/1998 | Chi |
| 5,729,841 | A | | 3/1998 | Chan |
| D405,535 | S | | 2/1999 | Schulz |
| D419,682 | S | | 1/2000 | Lie |
| 6,149,611 | A | | 11/2000 | Chen |
| 6,309,366 | B1 | | 10/2001 | Maxwell |
| 6,385,795 | B1 | * | 5/2002 | Ferber et al. ..... 4/622 |
| 6,393,633 | B2 | * | 5/2002 | Ferber ..... 4/622 |
| D463,030 | S | | 9/2002 | Ferber |

* cited by examiner

BATH APPARATUS

CROSS-REFERENCE TO RELATED APPLICATIONS

This is a continuation of copending application(s) Ser. No. 09/759,507 filed on Jan. 13, 2001 U.S. Pat. No. 6,393,633, which is a continuation-in-part of U.S. application Ser. No. 09/631,643 filed Aug. 2, 2000, U.S. Pat. No. 6,385,795.

TECHNICAL FIELD

This invention relates to an apparatus for bathing body parts, such as the feet or hands.

BACKGROUND ART

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of foot baths have been utilized as therapeutic devices for the feet. Typically, foot baths provide heated water for which the temperature is maintained via electrical means. In addition, current foot baths often provide massage to the feet through vibration of the foot bath. Vibratory massage enhances the therapeutic results achieved with soaking alone by further increasing circulation, as well as relaxing and massaging the muscles.

While heat and vibration applied to the feet in an overall manner is helpful, conventional foot baths are not designed with the capability to target specific areas of the feet. For example, it is common for a user to wish to concentrate treatment to a specific part or parts of his/her feet such as the ball, heel, or arch. Therefore, a need exists for a bath apparatus with the capability to focus heat and/or massage at specific locations of the body. Such a bath apparatus would not only allow users to tailor therapy regimens to their individual needs, but would also increase the speed at which therapy can be accomplished, thereby increasing the convenience for the user.

In addition to heat and vibratory massage, some foot baths are also capable of creating air bubbles in the water contained in the bath chamber. Contact of the air bubbles with a user's feet provides an additional type of massage therapy. However, current foot baths typically release bubbles only in limited areas of the foot bath, and therefore have only limited direct contact with the feet and few total bubbles produced. Accordingly, a further need exists for a bath apparatus with the capability of producing a greater number of bubbles and providing those bubbles over a greater portion of the bath chamber in order to increase contact with the user.

DISCLOSURE OF INVENTION

Therefore, it is an object according to the present invention to provide a bath apparatus for bathing body parts that is capable of providing targeted therapy, including heat and massage, to the body parts.

It is another object according to the present invention to provide an improved bath apparatus capable of creating a greater number of air bubbles within the bathing fluid for additional massage therapy.

It is a further object according to the present invention to provide an improved bath apparatus which provides air bubbles in direct contact with a greater portion of the bathed body parts.

Accordingly, an apparatus is provided for bathing body parts, such as the feet or hands. The bath apparatus includes a bath chamber for containing fluid, such as water, and receiving the body part therein. The bath chamber includes a bottom surface and a wall structure extending upwardly therefrom. The bath apparatus further includes a pump disposed adjacent to the bottom surface of the bath chamber, and a bubble egress tube in communication with the pump and the bath chamber bottom surface. The bubble egress tube has a continuous configuration which traverses a surface area of the bath chamber bottom surface having a width dimension greater than the width of the egress tube. A plurality of egress holes are formed in the bubble egress tube through which air from the pump is directed into the bath chamber in order to generate air bubbles in the fluid contained therein.

In one embodiment of the present invention, the bubble egress tube is disposed below the bath chamber bottom surface such that the egress holes are flush with the bottom surface. In an alternative embodiment, the bubble egress tube protrudes at least partially above the bath chamber bottom surface such that the egress holes are raised above the bottom surface. In this latter embodiment, the plurality of bubble egress holes can be positioned at multiple axial locations along the egress tube. In a preferred embodiment, the bottom surface has a first side and a second side, and first and second bubble egress tubes are disposed within the first and second sides of the bottom surface, respectively. The bubble egress tube can have a continuous curvilinear configuration, such as a serpentine or generally U-shaped configuration, or can include a continuous configuration of linear segments, such as a sawtooth or square-wave configuration.

In accordance with a preferred embodiment of the present invention, the wall structure includes a contact area adapted to be uncovered by fluid contained in the bath chamber. A heating member is preferably provided on the contact area for providing heat to the body part when the body part is placed on the contact area. In a preferred embodiment, the heating member uses infrared rays. In addition, a heater is provided in communication with the bath chamber for maintaining the heat of the fluid contained therein. Preferably, the heater includes a rope heating element provided underneath the bottom surface of the bath chamber. Furthermore, the bath apparatus includes a vibration assembly in communication with the bath chamber for imparting vibration to the bath chamber. The vibration assembly includes a motor affixed to an underside of the bath chamber, an output shaft rotatably driven by the motor, and a counterweight affixed to the output shaft.

In further accordance with the present invention, the bath apparatus includes at least one massage attachment adapted to be received on the contact area for massaging the body part when the body part engages the massage attachment. The massage attachment can be stationary, or can be manually rotatable by a user. Alternatively, rotation of the massage attachment can be motorized. In this embodiment, a motor is disposed on the underside of the bath chamber, and the massage attachment is adapted to be received on an output shaft that is rotatably driven by the motor and adapted to be accessible through the contact area. Optionally, the motorized rotation of the massage attachment can be activated by applied pressure of the body part on the massage attachment.

According to the present invention, an outer housing is provided to encase the bath chamber. Preferably, the bath chamber is generally U-shaped and the contact area is generally peninsular, such that the contact area is centrally disposed within the bath chamber. The bath chamber preferably includes a plurality of raised nodes provided on its bottom surface. Additionally, the bottom surface of the bath chamber can include rollers provided thereon, wherein the rollers can be detachable from the bottom surface. The bath apparatus can also include a lid adapted to be attached to the wall structure to at least partially cover the bath chamber.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
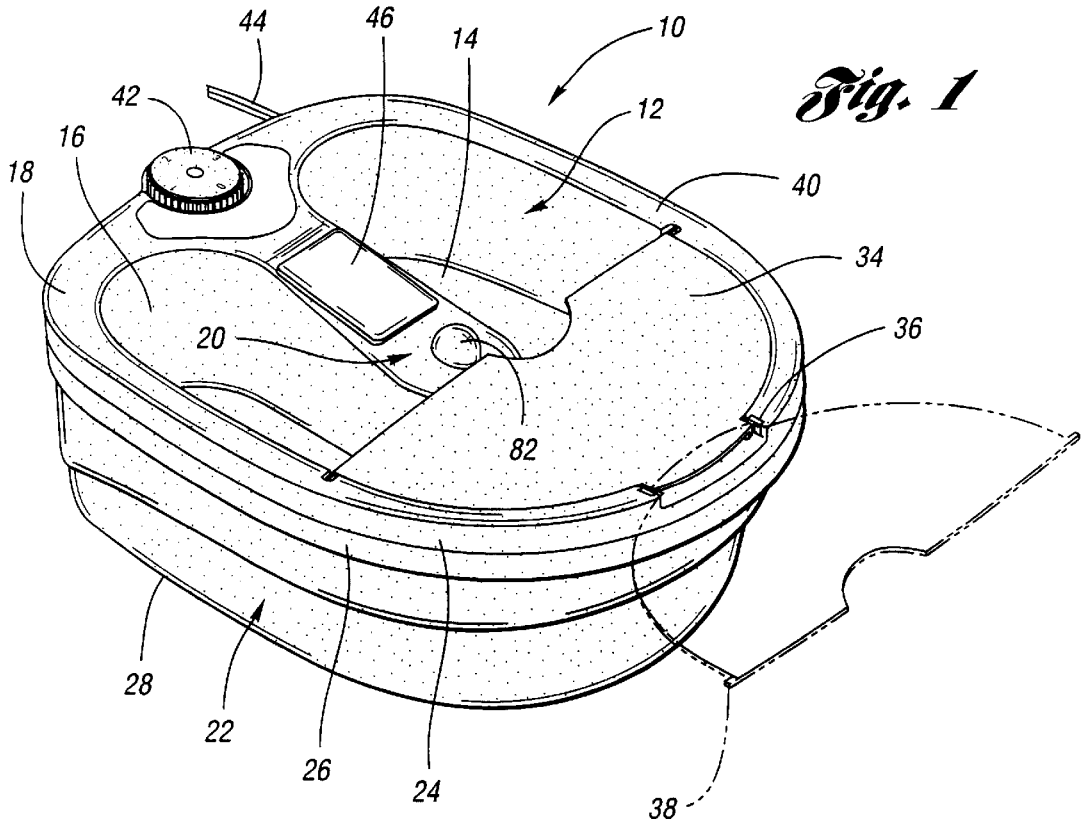
FIG. 1 is a perspective view of a bath apparatus constructed in accordance with the present invention.

Referring first to FIGS. 1–8, a bath apparatus constructed according to the present invention is depicted and designated generally by reference numeral 10. Bath apparatus 10 can be used to provide heat, massage, bubbles, and combinations thereof to body parts, such as the feet. Bath apparatus 10 is preferably constructed from a plastic material so as to be lightweight and portable, as well as durable, leakproof, and corrosion resistant. Although bath apparatus 10 is illustrated and described herein as being particularly adaptable for use as a foot bath, it is understood that bath apparatus 10 of the present invention may be used for bathing other body parts, such as the hands.

With reference to FIG. 1, bath apparatus 10 includes a bath chamber 12 for containing fluid, such as water, and receiving the body part, such as the foot, therein. Bath chamber 12 includes a floor or bottom surface 14 and a wall structure 16 extending upwardly therefrom. Wall structure 16 terminates in an upper surface 18 that includes a contact portion 20 adapted to be exposed when water is contained in bath chamber 12. Bottom surface 14 can be generally parallel to a supporting surface on which bath apparatus 10 is placed or, alternatively, bottom surface 14 could be slanted downwardly toward the user.

Figure 2:
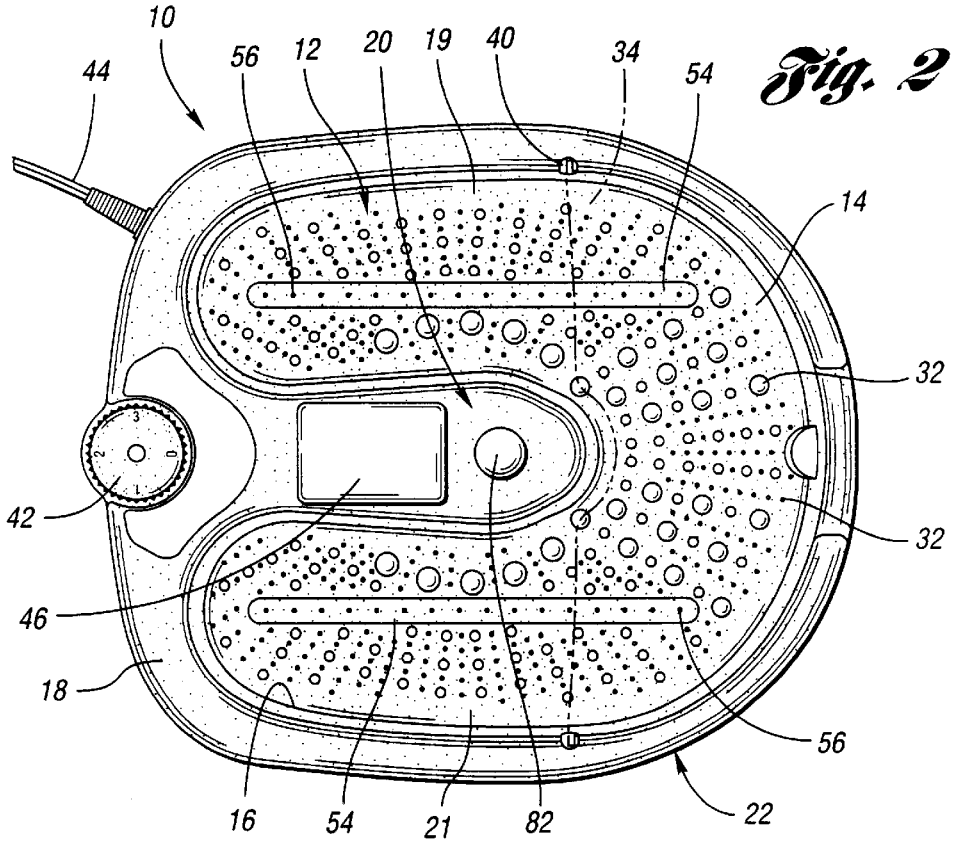
FIG. 2 is a top plan view of the bath apparatus of FIG. 1.

Bath chamber 12 is of a length and width to accommodate the feet of an adult user, such that sufficient space is provided to permit the user to readily insert and remove his/her foot and to allow the foot to be moved about slightly while in position within bath chamber 12. As shown in FIGS. 1 and 2, bath chamber 12 is generally U-shaped and contact portion 20 is generally peninsular and centrally disposed within bath chamber 12. With this configuration, a user's feet are received on either side of peninsular contact portion 20, also denoted as first side 19 and second side 21 of bottom surface 14, wherein the feet are spaced apart sufficiently to provide comfortable placement. For use, bath chamber 12 is filled with water such that a user, preferably seated, submerses his/her feet up to approximately the height of the ankles. A user can then easily remove his/her foot for placement on contact portion 20 for targeted therapy as described below. Of course, it is understood that contact portion 20 can have any location on bath apparatus 10 which remains uncovered by water and is accessible to the user.

Figure 3:
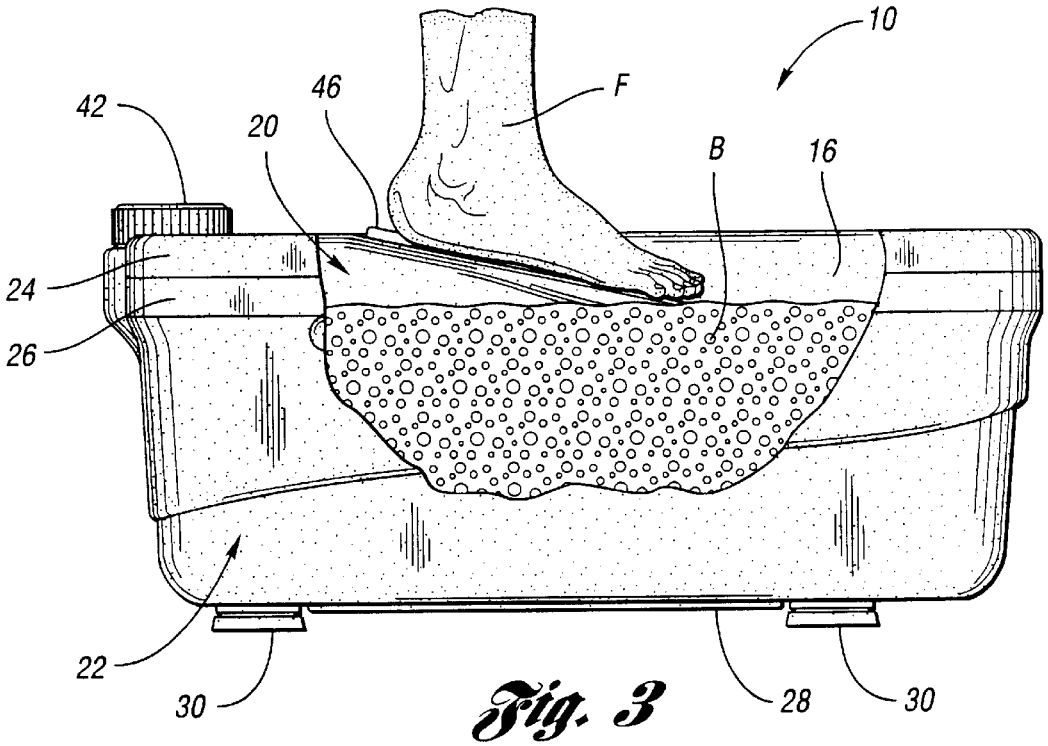
FIG. 3 is a side elevational view of the bath apparatus of FIG. 1, wherein the wall structure is partially cut away to show a user's foot engaging the contact portion.

An outer housing 22 is provided to encase bath chamber 12, wherein outer housing 22 is spaced from bath chamber 12 to provide a location for housing the various mechanical/electrical assemblies of bath apparatus 10, as described below with reference to FIG. 4. As best shown in FIGS. 1 and 3, upper surface 18 of bath chamber 12 includes a downwardly extending flange 24 which aligns with an upwardly extending flange 26 of outer housing 22. Flanges 24, 26 are secured together by screws (not shown) to fix bath chamber 12 in position with respect to outer housing 22. The base 28 of outer housing 22 is preferably provided with feet 30 constructed from a material such as rubber to prevent movement of bath apparatus 10 along a supporting surface.

Figure 9:
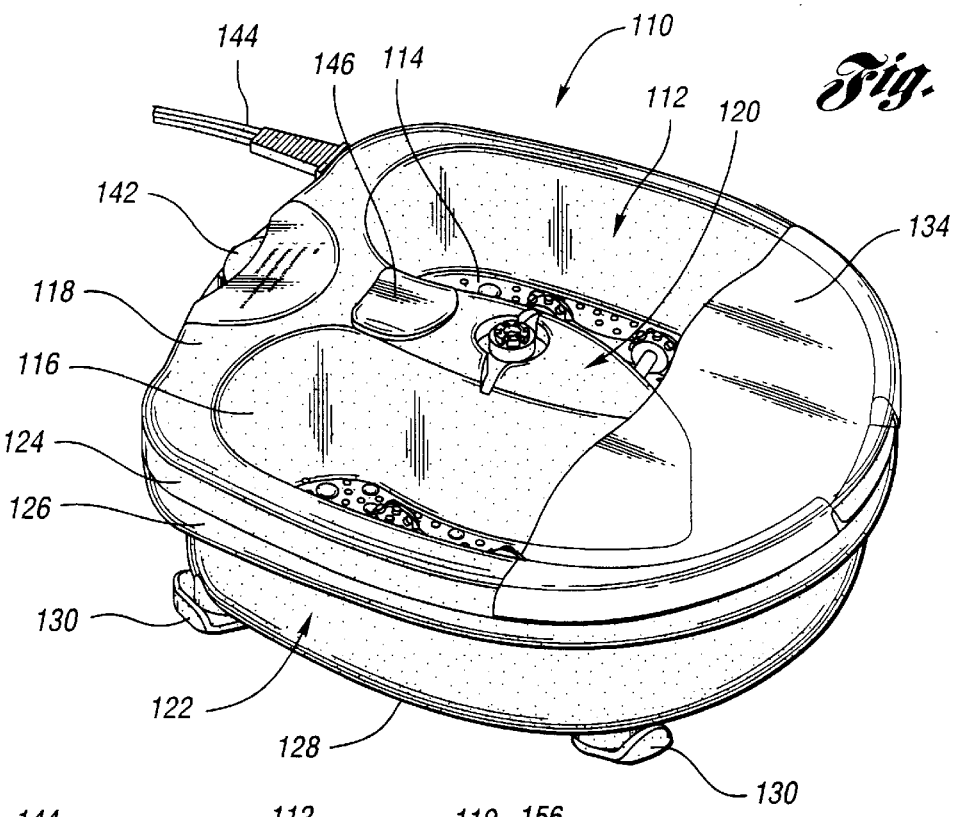
FIG. 9 is a perspective view of a second embodiment of the bath apparatus according to the present invention.
Figure 10:
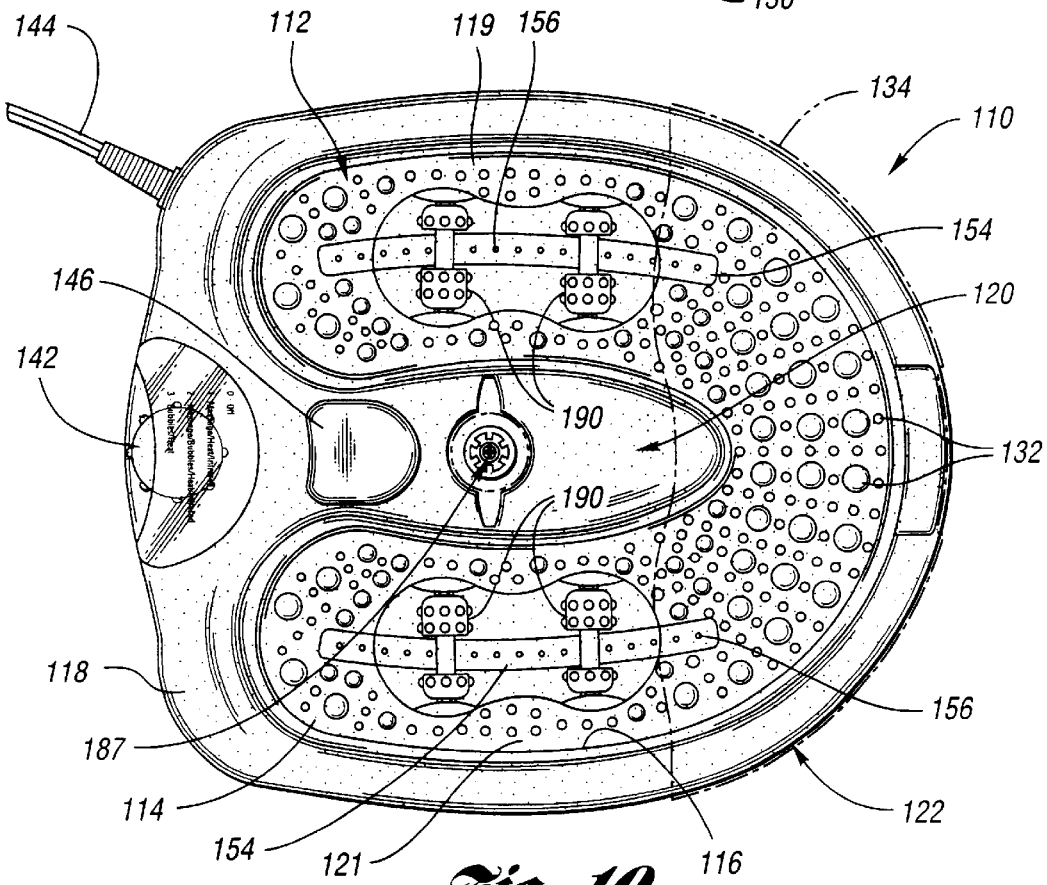
FIG. 10 is a top plan view of the bath apparatus of FIG. 9.
Figure 11:
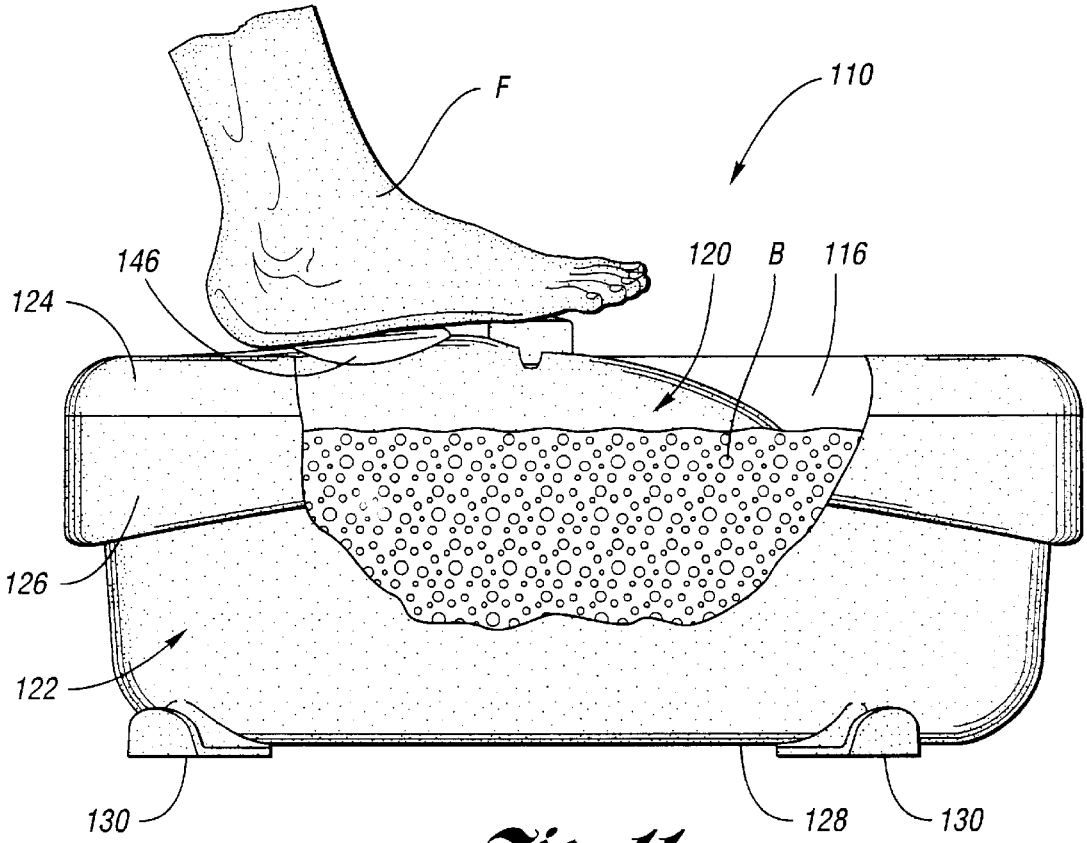
FIG. 11 is a side elevational view of the bath apparatus of FIG. 9, wherein the wall structure is partially cut away to show a user's foot engaging the contact portion.

Referring again to the top plan view of FIG. 2, bottom surface 14 of bath chamber 12 preferably includes a plurality of raised nodes 32 which can be of varying sizes. Nodes 32 function to massage the feet upon contact, and also allow water and heat to flow under the feet to improve blood circulation. As shown in FIGS. 1 and 2, bath apparatus 10 further includes a lid 34 adapted to be attached to wall structure 16 to at least partially cover bath chamber 12. As shown, lid 34 is attached to wall structure 16 by a hinge 36, and includes tabs 38 that are securely received in corresponding openings 40 provided on wall structure 16. Therefore, as shown in FIG. 1, lid 34 can be positioned to partially cover bath chamber 12 to prevent any accidental splashing of water, or lid 34 can be rotated away from bath chamber 12 about hinge 36 for ease of inserting and removing the feet and filling bath chamber 12 with water. Alternatively, as shown in the embodiment of FIGS. 9–10, lid 134 can simply snap fit over wall structure 16 to be completely removable. Lid 34 is preferably constructed from a plastic material, and is sufficiently rigid so that it can be used as a foot rest when only one foot is submersed within bath chamber 12.

Referring again to FIGS. 1–3, a selector 42 is located on upper surface 18 of bath chamber 12, wherein selector 42 is rotatable by a user to selectively provide various combinations of heat, massage, and bubbles to the feet. Wiring interconnects selector 42 with each of the mechanical/electrical assemblies described below which are then powered via connection of a standard power cord 44 to any 110 V AC outlet. In a preferred embodiment, selector 42 can be set to provide three different combinations of bath functions: 1) vibration massage, chamber heat, and targeted infrared heat; 2) vibration massage, bubbles, chamber heat, and targeted infrared heat; and 3) bubbles and chamber heat. However, it is understood that other combinations are fully contemplated in accordance with the present invention.

With reference to FIGS. 1–4, the several mechanical/electrical assemblies of bath apparatus 10 of the present invention will now be described. Each of the following assemblies is housed in the space between bath chamber 12 and outer housing 22 and is selectively powered as determined by the setting of selector 42. First, a heating member 46 is provided on contact portion 20 for providing heat to the foot surface when the foot F is placed on contact portion 20. Advantageously, heating member 46 provides the capability of focusing heat on the specific region of the foot desired by the user. According to a preferred embodiment of the present invention, heating member 46 uses infrared rays. Infrared rays allow heat to penetrate deep underneath the surface of the skin, causing the pores of the skin to be opened and promoting metabolism and excretion of the body through increased blood circulation. The applied pressure of the foot on heating member 46 can be adjusted by the user for optimum comfort. Although the surface of heating member 46 is shown herein to be generally flat, heating member 46 could have any contour suitable for contact with a user's foot.

In addition to heating member 46, a heater is provided in communication with bath chamber 12. As best shown in FIG. 4, the heater preferably includes a rope heating element 48 secured underneath bottom surface 14 of bath chamber 12. Upon receiving electrical power, as determined by selector 42, rope heating element 48 is operable to conduct heat to the water contained within bath chamber 12. The heated water maintained by rope heating element 48 relieves tired muscles and promotes circulation of the blood. Rope heating element 48 is positioned to wind back and forth to substantially cover bath chamber bottom surface 14. Rope heating element 48 preferably includes insulated conducting wires, wherein the conductive materials are capable of transmitting heat to bath chamber bottom surface 14 without generating temperatures that exceed the melting point of the plastic material used to construct bath apparatus 10.

Bath apparatus 10 further includes a pump 50 disposed adjacent to bottom surface 14 of bath chamber 12 and in communication therewith. Pump 50 directs air into bath chamber 12 to generate air bubbles in the water contained therein. As shown in FIG. 4, pump 50 forces air through outlet tubes 52 which are connected to injection molded bubble egress strips or tubes 54 formed in communication with bath chamber bottom surface 14. Air is forced out of a plurality of egress holes 56 that are provided along each bubble egress tube 54 to form air bubbles B in the water contained in bath chamber 12, as illustrated in FIG. 3. Of course, outlet tube 52 and egress tube 54 could be constructed as a single component. In a preferred embodiment, one egress tube 54 is disposed within first side 19 of bottom surface 14, and the other egress tube 54 is disposed within the second side 21 of bottom surface 14. Alternatively, a single egress tube 54 could be constructed to extend between and generally traverse both first and second sides 19, 21.

Figure 4:
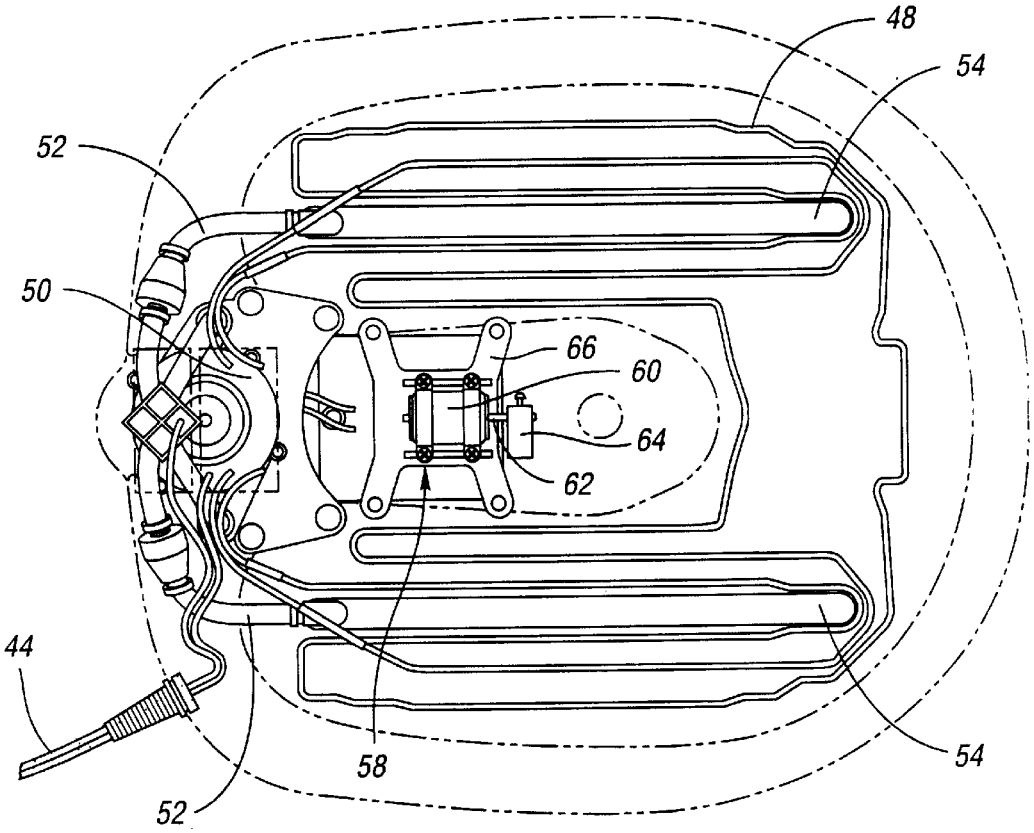
FIG. 4 is a fragmentary view of the pump, heating, and vibration assemblies located on the underside of the bath chamber.
Figure 5:
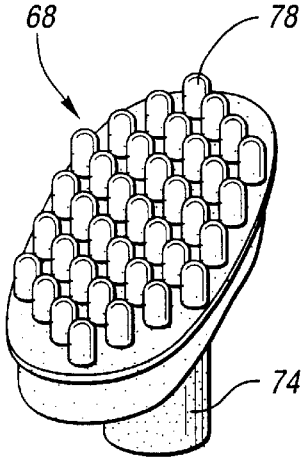
FIG. 5 is a perspective view of a first stationary massage attachment adapted to be received on the contact portion.
Figure 6:
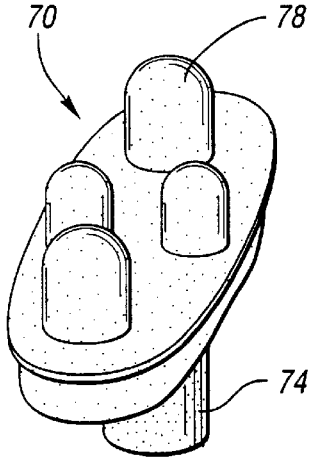
FIG. 6 is a perspective view of a second stationary massage attachment.
Figure 7:
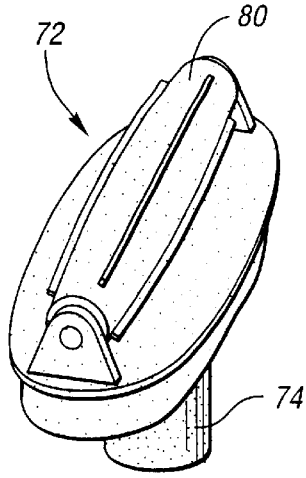
FIG. 7 is a perspective view of a roller massage attachment.
Figure 8A:
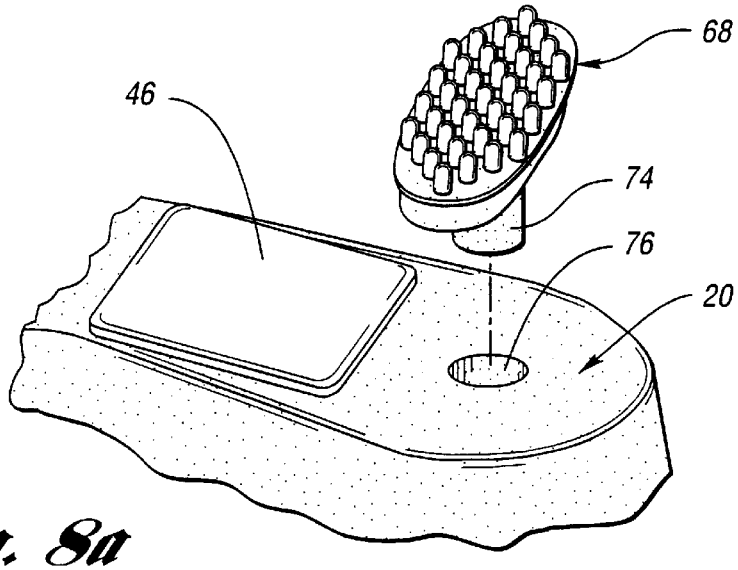
FIGS. 8*a* and 8*b* are fragmentary perspective views of the first stationary massage attachment before and after attachment to the contact portion, respectively.
Figure 8B:
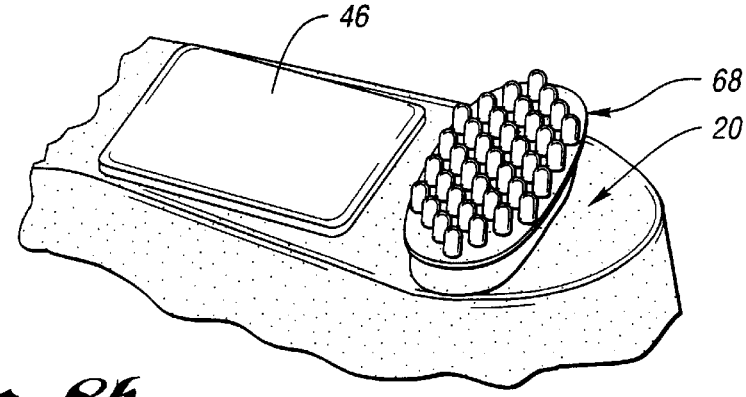
Figure 22:
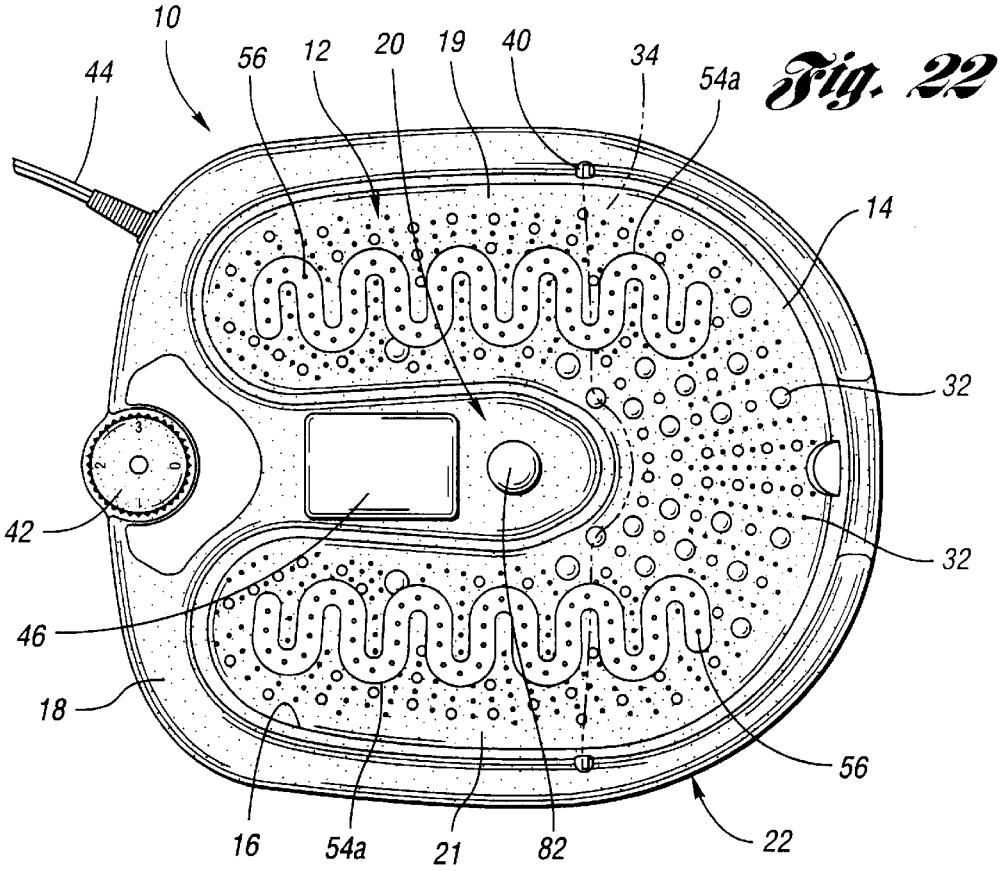
FIG. 22 is a top plan view of the bath apparatus of FIG. 1 showing bubble egress tubes having a serpentine configuration.
Figure 23:
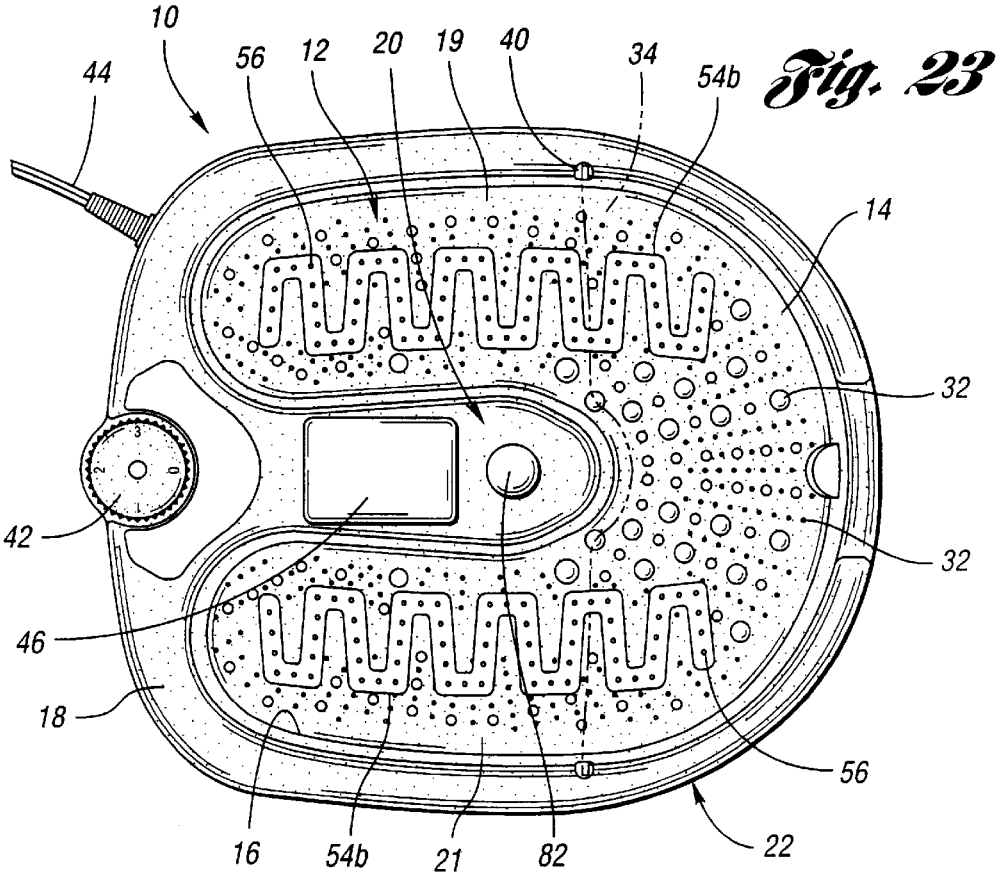
FIG. 23 is a top plan view of the bath apparatus of FIG. 1 showing bubble egress tubes having a square-wave configuration.
Figure 24:
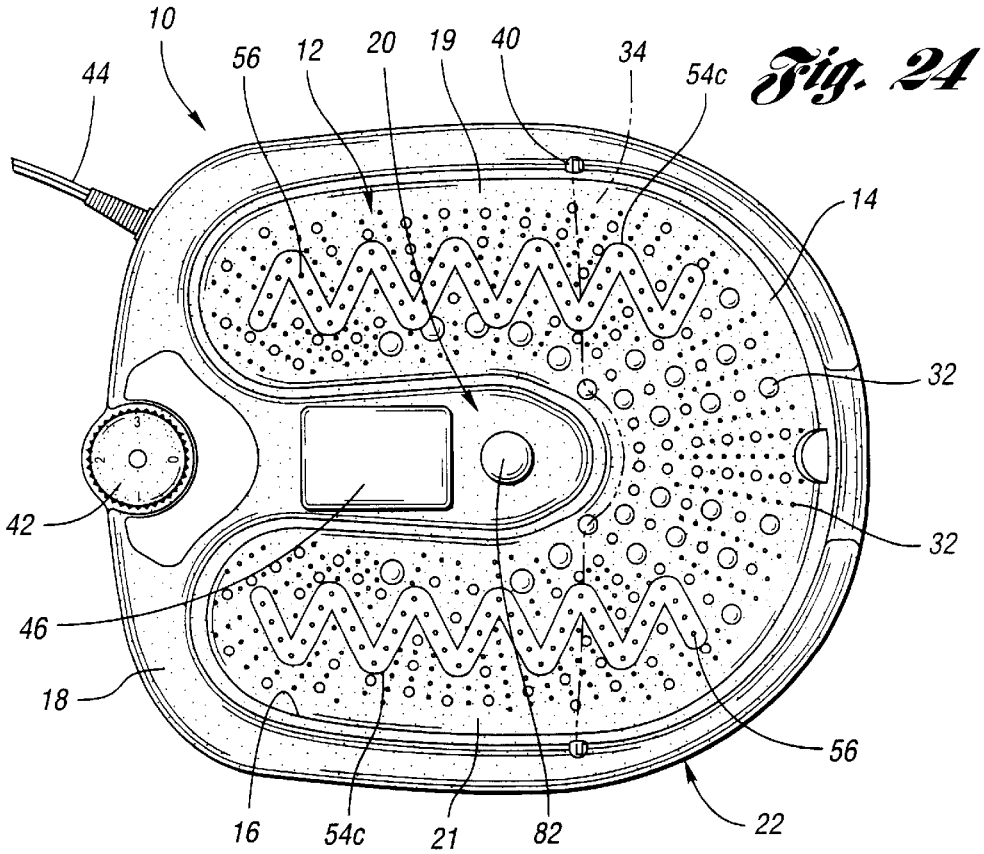
FIG. 24 is a top plan view of the bath apparatus of FIG. 1 showing bubble egress tubes having a sawtooth configuration.
Figure 25:
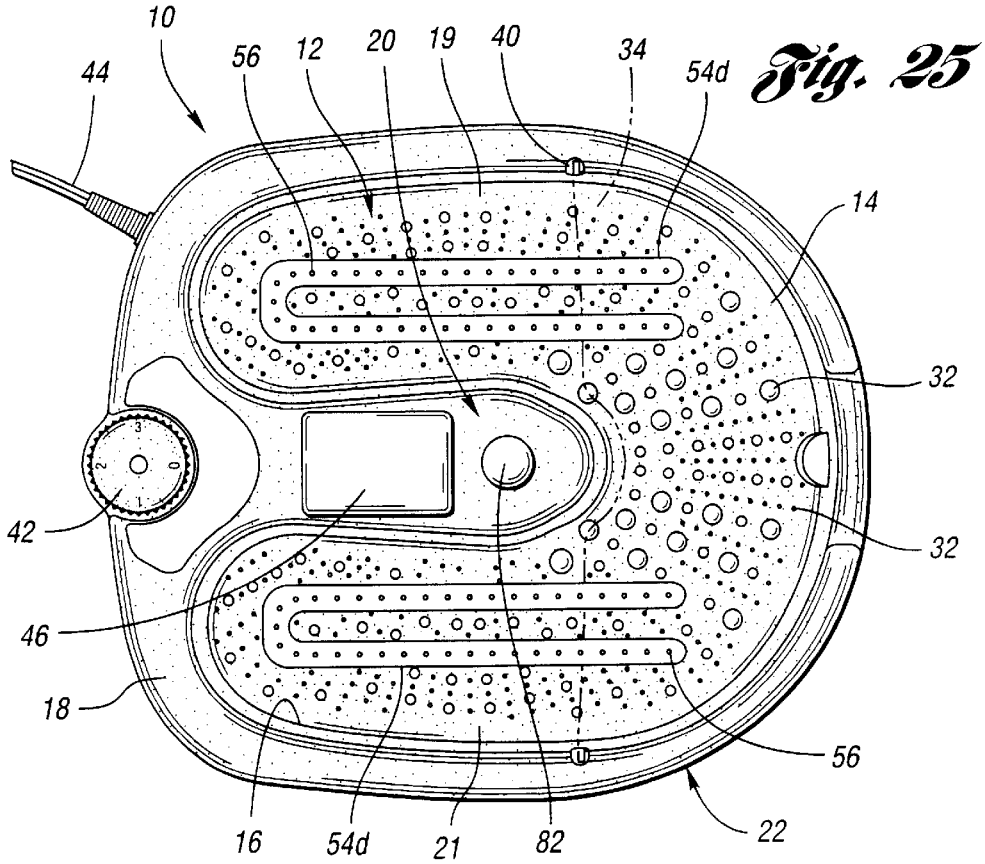
FIG. 25 is a top plan view of the bath apparatus of FIG. 1 showing bubble egress tubes having a generally U-shaped configuration.
Figure 26:
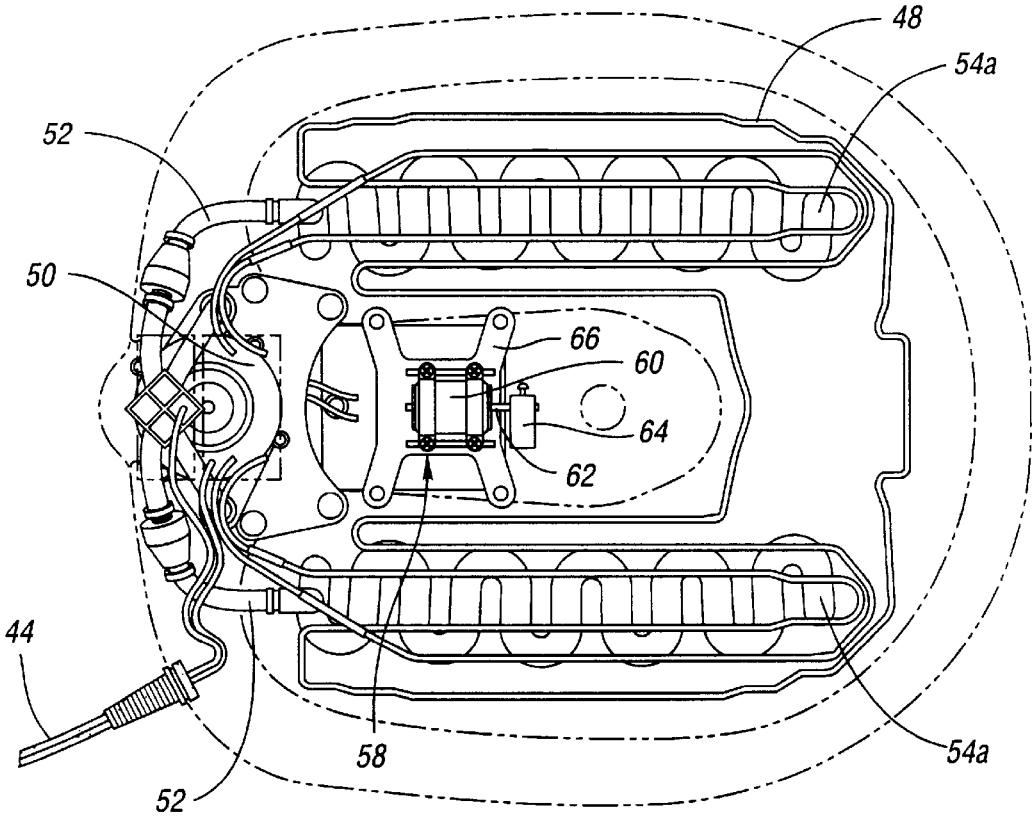
FIG. 26 is a fragmentary view of the pump, heating, and vibration assemblies located on the underside of the bath chamber for the bubble egress tube configuration of FIG. 22.
Figure 27:
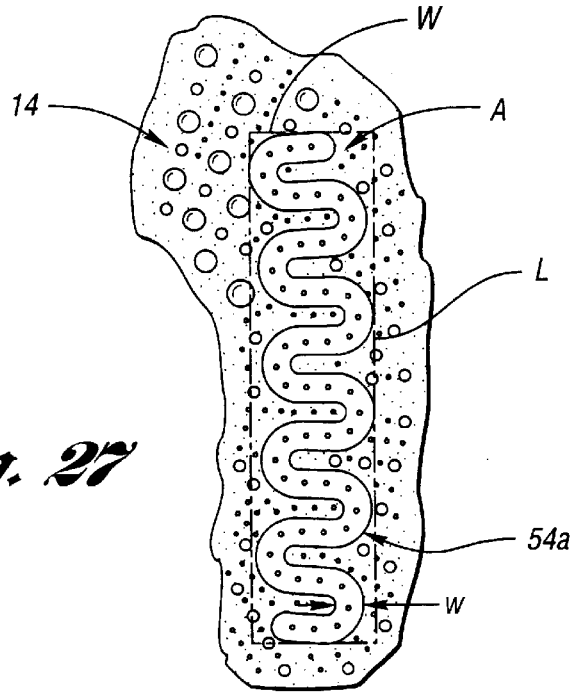
FIG. 27 is an enlarged, fragmentary view of the bath chamber bottom surface for the bubble egress tube configuration of FIG. 22 showing the surface area and related dimensions traversed by the egress tube.

In addition to the generally linear configuration of bubble egress tubes 54 depicted in FIGS. 2 and 4, bubble egress tubes 54 can be constructed to have various configurations which provide more complete coverage of bath chamber bottom surface 14. For example, bubble egress tubes 54 can have a continuous curvilinear configuration including at least one generally S-shaped segment or at least one reverse curve, such as the serpentine configuration 54*a* shown in (FIGS. 22 and 26). Alternatively, bubble egress tubes 54 can have a generally U-shaped 54*d* configuration (FIG. 25), or can include a continuous configuration of linear segments, such as a square-wave 54*b* (FIG. 23) or a sawtooth 54*c* (FIG. 24) configuration. In more general terms, and with reference to FIG. 27, bubble egress tube 54 continuously traverses a surface area A of bath chamber bottom surface 14 having a width dimension W and a length dimension L, where width dimension W is greater than the width w of egress tube 54.

This configuration increases the capability for generating bubbles within a given area of bottom surface 14, and provides air bubbles in direct contact with a significant portion of the bathed body part. Advantageously, these continuous configurations require at most one bubble egress tube 54 on each side 19, 21 of bath chamber bottom surface 14. It is understood that other egress tube embodiments in addition to the examples illustrated in FIGS. 22–25, such as mirror images, angular rotations, and other variations thereof are fully contemplated in accordance with the present invention.

Figure 28:
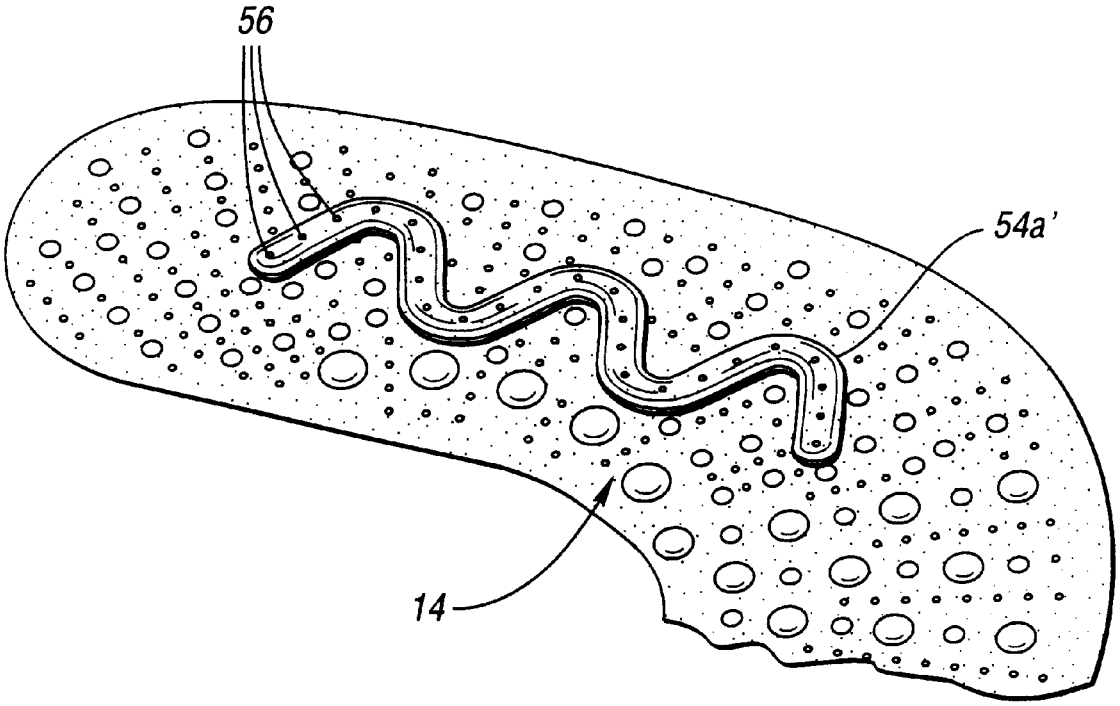
FIG. 28 is an enlarged, fragmentary view of the bath chamber bottom surface illustrating a raised embodiment of the bubble egress tube.

In the embodiments depicted in FIGS. 2 and 22–25, bubble egress tubes 54 are disposed below bath chamber bottom surface 14, such that the plurality of egress holes 56 are flush with bottom surface 14. In an alternative embodiment illustrated in FIG. 28, bubble egress tubes 54*a*' protrude at least partially above bottom surface 14, such that egress holes 56 are raised above bottom surface 14. As shown in this latter embodiment, the plurality of bubble egress holes 56 can be positioned at multiple axial locations along the egress tube 54*a*', thereby providing an even greater ability to generate bubbles within a given area of bottom surface 14. Of course, it is understood that the use of serpentine configuration 54*a*' for this raised tube embodiment is merely exemplary, and that any of the other egress tube configurations contemplated above could likewise be provided as such. Furthermore, any of the configurations of bubble egress tubes 54 described herein with reference to FIGS. 22–28 could also be included as part of bath apparatus 110 described below with reference to FIGS. 9–21.

Still further, bath apparatus 10 includes a vibration assembly 58 in communication with bath chamber 12 for imparting vibration to bath chamber 12 to provide a massaging effect to the feet. Vibration assembly 58 includes a motor 60 affixed to an underside of bath chamber 12, an output shaft 62 rotatably driven by motor 60, and a counterweight 64 affixed to output shaft 62. Vibration assembly 58 is affixed underneath a central portion of bath chamber 12 by a motor support bracket 66. When motor 60 is electrically powered, rotation of output shaft 62 and attached counterweight 64 imparts vibrations to motor support bracket 66, and these vibrations are then transferred to bath chamber 12 and the water contained therein in order to massage the feet. It is fully contemplated that variable vibration intensities could be provided in accordance with the present invention.

Turning now to FIGS. 5–8, in further accordance with the present invention, bath apparatus 10 includes one or more interchangeable massage attachments 68, 70, 72 adapted to be received on contact portion 20 for massaging the foot F upon engagement. As with infrared heating member 46, massage attachments 68, 70, 72 advantageously allow for massage to be targeted to specific locations of the foot such as the ball, heel, or arch. In greater specificity, attachments 68, 70, 72 each include a projection 74 sized to be received in a corresponding recess 76 provided in contact portion 20, as illustrated in FIGS. 8*a* and 8*b*. Massage attachments 68 and 70 depicted in FIGS. 5 and 6, respectively, remain stationary once received by contact portion 20, and include different sizes and configurations of raised nodes 78 to provide gently concentrated pressure to a user's foot. Massage attachment 72 includes a roller 80 which is manually rotatable, allowing a user to glide his/her foot back and forth upon roller 80 to release tension. As best shown in FIGS. 1 and 2, a cap 82 is provided to be received in recess 76 when the massage attachments 68, 70, 72 are not in use. Of course, massage attachments 68, 70, 72 are shown only by way of example, and any other suitable massage attachment may be utilized with the present invention.

FIGS. 9–21 illustrate a second embodiment of the bath apparatus according to the present invention, which operates substantially similarly to bath apparatus 10 except for the additional motorized massage and bottom surface features described below. The reference numerals for FIGS. 9–21 correspond generally with the reference numerals for FIGS. 1–8 except for the addition of a "1" prefix.

Figure 12:
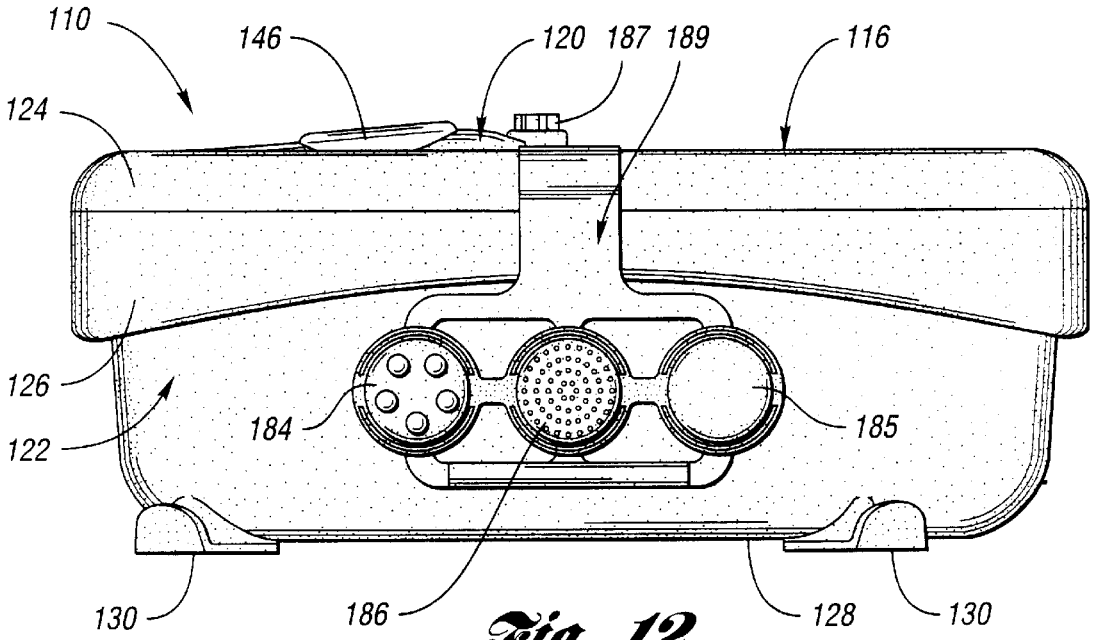
FIG. 12 is a side elevational view of the bath apparatus of FIG. 9 showing a storage unit for the massage attachments hanging from the wall structure.
Figure 13:
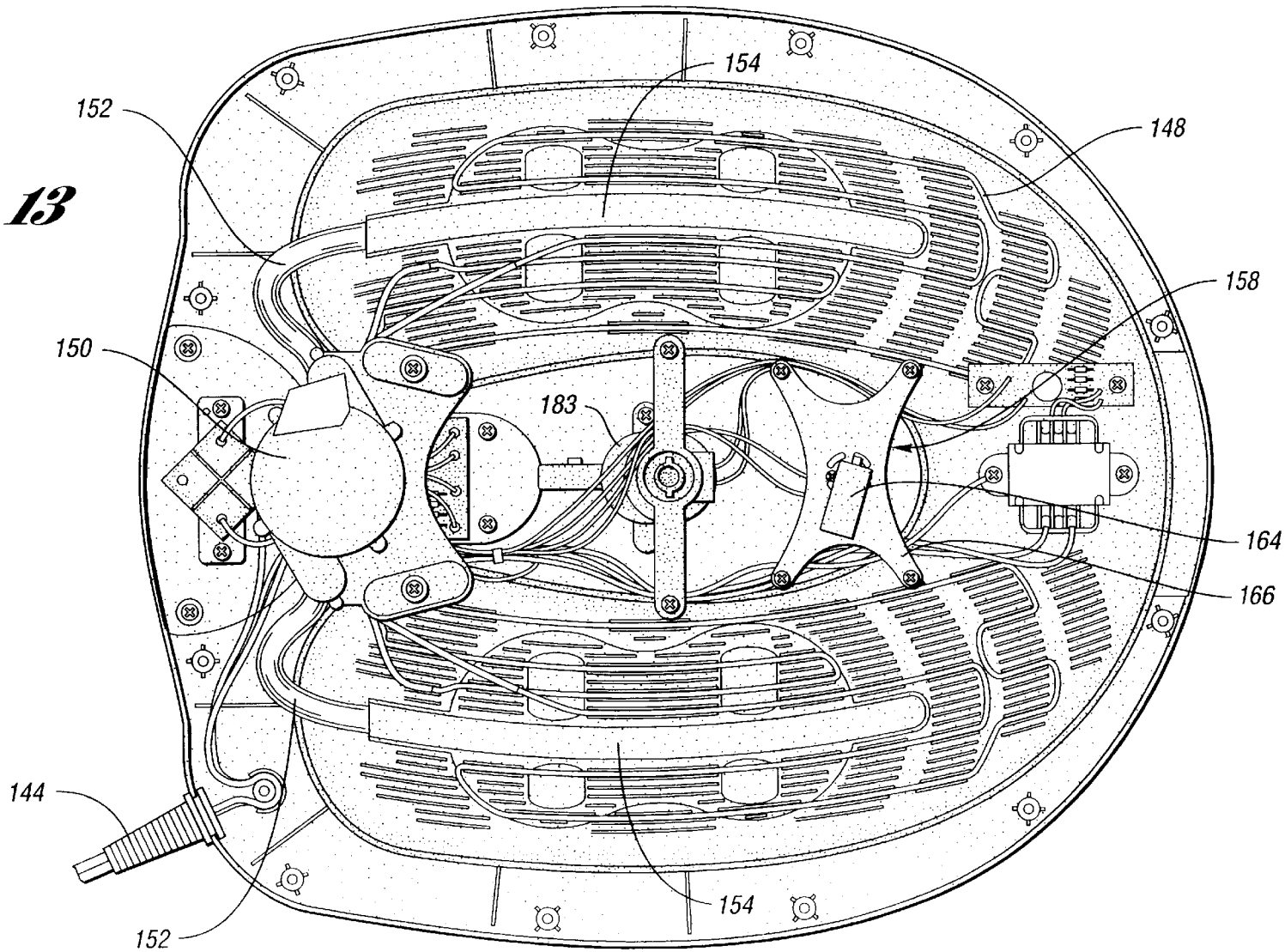
FIG. 13 is a fragmentary view of the pump, heating, vibration, and massage assemblies located on the underside of the bath chamber.

Bath apparatus 110 includes a contact portion 120 for receiving massage attachments 184, 185, 186 (shown in FIGS. 14–18), wherein rotation of massage attachments 184, 185, 186 is motorized. As shown in FIG. 12, a motor 183 is disposed on an underside of bath chamber 112, and massage attachments 184, 185, 186 are adapted to be received on an output shaft 187 that is rotatably driven by motor 183 and adapted to be accessible through contact portion 120. With reference to FIGS. 15 and 18, massage attachments 184, 185, 186 each include a recess 188 configured to securely receive output shaft 187 as it projects through contact portion 120. More particularly, recess 188 includes a plurality of tabs 194 sized to be received in corresponding slots 195 provided on output shaft 187. Therefore, rotation of output shaft 187 causes massage attachments 184, 185, 186 to rotate, even when in contact with a user's foot F. Optionally, the motorized rotation of massage attachments 184, 185, 186 can be activated by pressure of the foot F applied thereon, which then establishes electrical contact to supply power to motor 183. In this case, the operation of motor 183 is preferably not governed by selector 142, but rather power is supplied to motor 183 as long as bath apparatus 110 is plugged in.

Figure 14:
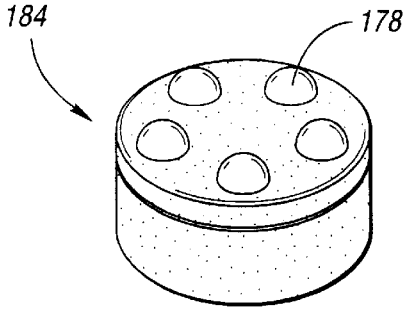
FIG. 14 is a perspective view of a first rotatable massage attachment adapted to be received on the contact portion.
Figure 15:
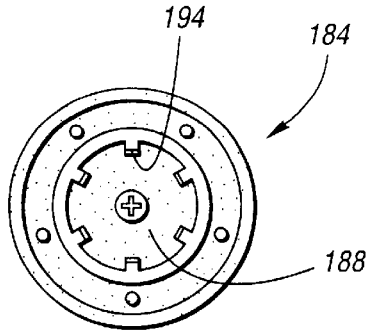
FIG. 15 is a bottom plan view of the first rotatable massage attachment.
Figure 16:
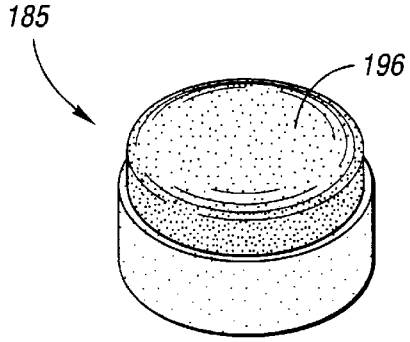
FIG. 16 is a perspective view of a second rotatable massage attachment which includes a pumice stone.
Figure 17:
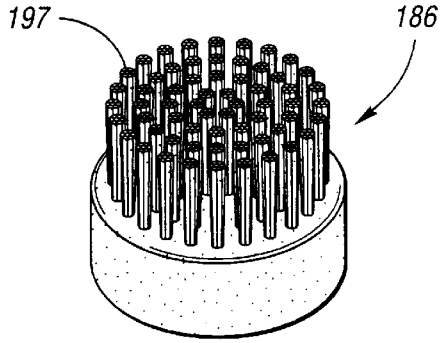
FIG. 17 is a perspective view of a third rotatable massage attachment which includes a brush.
Figure 18A:
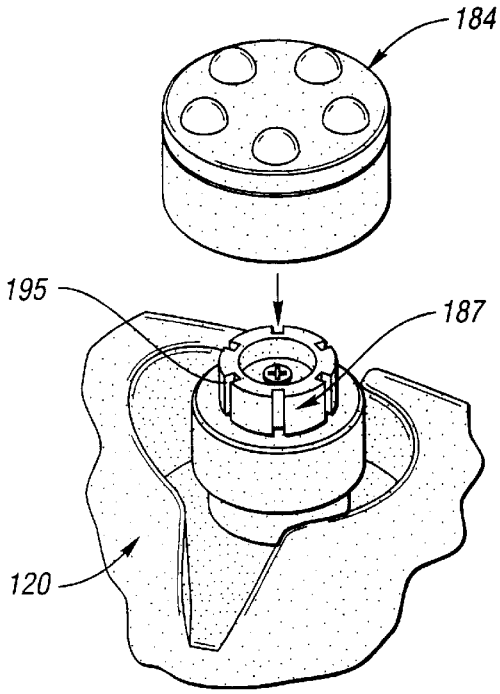
FIGS. 18*a* and 18*b* are fragmentary perspective views of the first rotatable massage attachment before and after attachment to the contact portion, respectively.
Figure 18B:
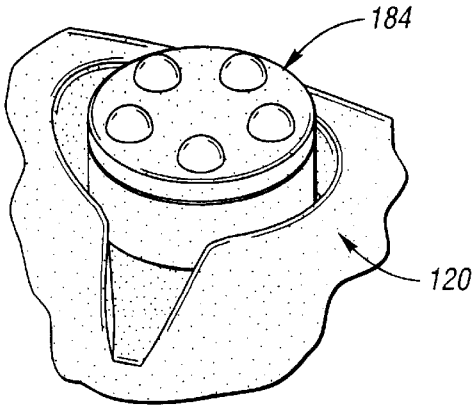
Figure 19:
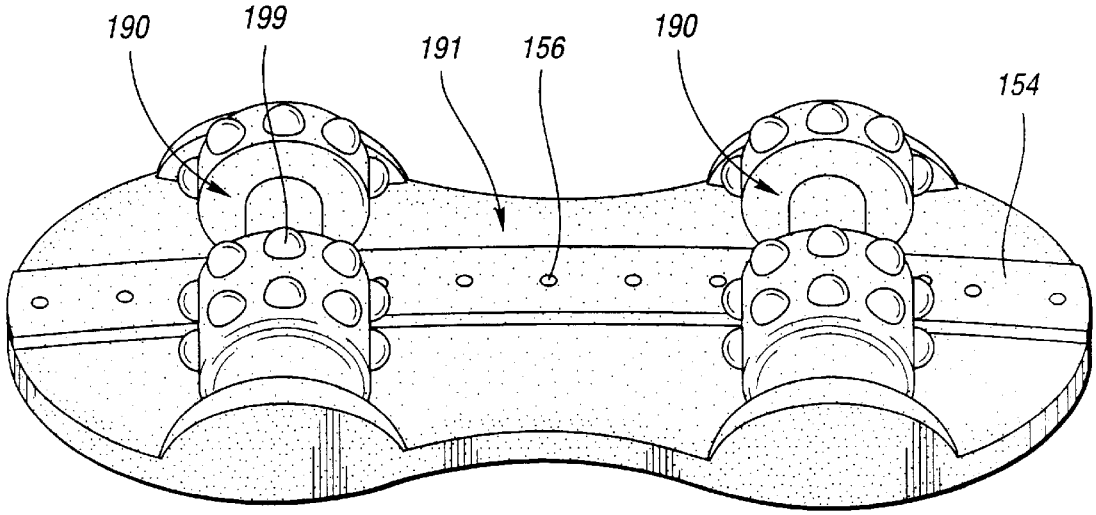
FIG. 19 is a perspective view of a base plate adapted to be received on the bath chamber bottom surface, wherein the base plate includes rollers rotatably affixed thereto.
Figure 20:
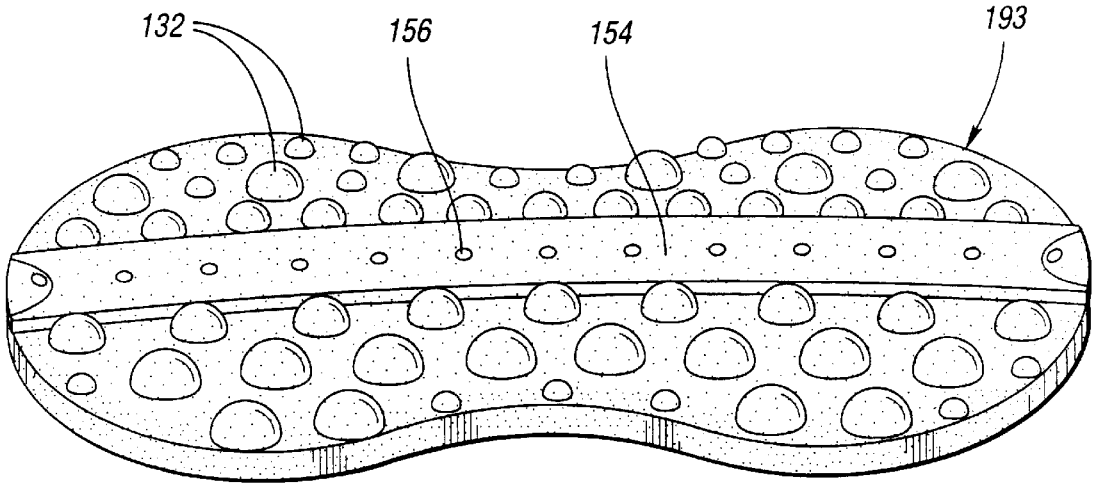
FIG. 20 is a perspective view of a base plate without rollers.
Figure 21A:
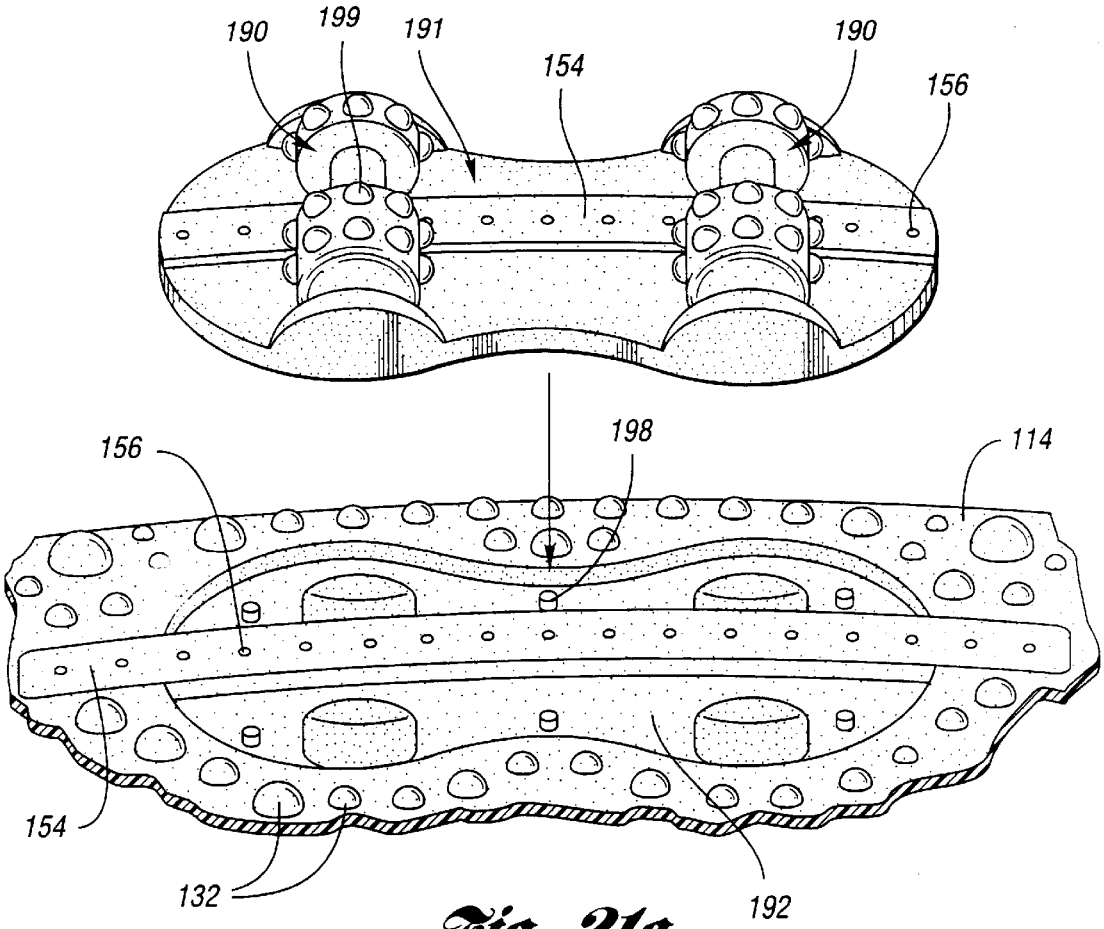
FIGS. 21*a* and 21*b* are fragmentary perspective views of the roller base plate before and after attachment to the bath chamber bottom surface, respectively.
Figure 21B:
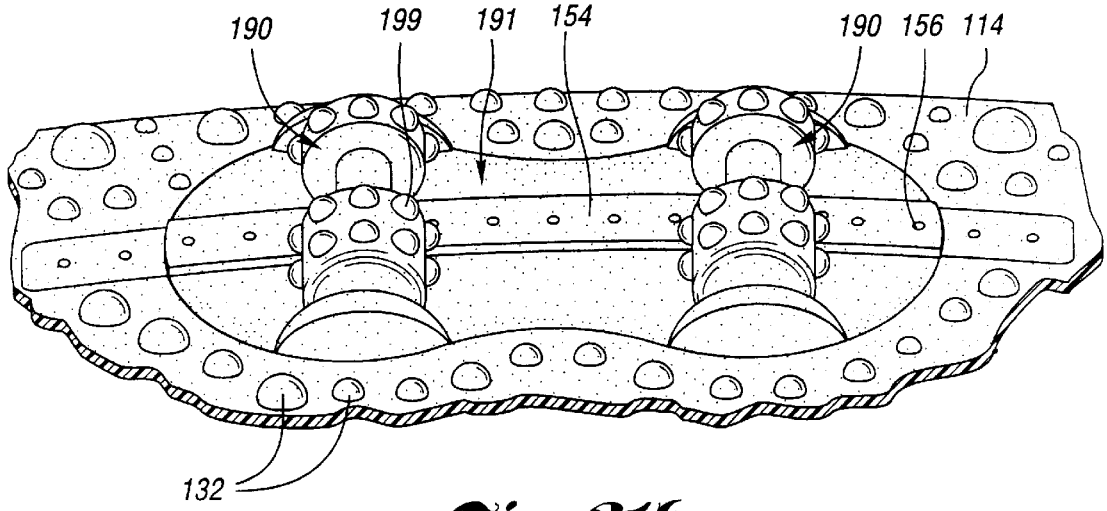

Three different massage attachments for use with bath apparatus 110 are illustrated in FIGS. 14–17. A first rotatable massage attachment 184, as shown in FIG. 14, includes raised nodes 178 which provide pressure points to gently massage a user's foot F when contacted. FIG. 16 depicts a second rotatable massage attachment 185 that includes a pumice stone 196 to smooth and soften skin on the soles of the feet, and FIG. 17 depicts a third rotatable massage attachment 186 that includes a brush 197 to clean and exfoliate skin. As shown in FIG. 12, a storage unit 189 is provided which is adapted to be attached to wall structure 116 for storing the one or more massage attachments 184, 185, 186 therein when not in use. Again, the particular massage attachments 184, 185, 186 shown and described herein are merely exemplary, and any other suitable massage attachment can be used in accordance with the present invention.

Referring now to FIGS. 10 and 19–21, bath apparatus 110 further includes a bottom surface 114 which can include detachable rollers 190 provided thereon. A user can glide his/her foot back and forth across rollers 190 to help relieve tightness and tiredness along soles of feet, as well as for reflexology purposes. Rollers 190 include raised massage nodes 199, and can be attached and detached directly on bottom surface 114. In a preferred embodiment, rollers 190 are rotatably attached to a roller plate 191, which is detachable from bottom surface 114, as shown in FIGS. 21*a* and 21*b*. In this embodiment, bottom surface 114 includes indented regions 192 sized to receive roller plates 191 therein, wherein indented regions 192 are of an appropriate depth to allow for roller plates 191 to be generally level with bottom surface 114 when inserted. Furthermore, bottom surface 114 and plates 191, 193 include mating projections 198 and recesses (not shown) for securing plates 191, 193 to bottom surface 114. When a user does not wish to use rollers 190, roller plate 191 can be removed and interchanged with an alternative foot plate 193 which resembles the existing contour of bottom surface 114.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for baffling a body part, the apparatus comprising:

a bath chamber for containing fluid and receiving the body part therein, the bath chamber including a bottom surface and a wall structure extending upwardly therefrom;

a pump in communication with the bottom surface of the bath chamber; and at least one bubble egress tube in communication with the pump and the bath chamber bottom surface, the at least one bubble egress tube having a configuration including at least one generally S-shaped segment and including a plurality of egress holes formed therein through which air from the pump is directed into the bath chamber in order to generate air bubbles in the fluid contained therein.

2. The apparatus according to claim 1, wherein the bubble egress tube is disposed below the bath chamber bottom surface such that the egress holes are flush with the bottom surface.

3. The apparatus according to claim 1, wherein the bubble egress tube protrudes at least partially above the bath chamber bottom surface such that the egress holes are raised above the bottom surface.

4. The apparatus according to claim 3, wherein the plurality of bubble egress holes are positioned at multiple axial locations along the egress tube.

5. The apparatus according to claim 1, wherein the bath chamber includes a contact area adapted to be uncovered by fluid contained therein.

6. The apparatus according to claim 5, further including a heating member provided on the contact area for providing heat to the body part when the body part is placed on the contact area.

7. The apparatus according to claim 6, wherein the heating member uses infrared rays.

8. The apparatus according to claim 5, further including at least one massage attachment adapted to be received on the contact area for massaging the body part when the body part engages the massage attachment.

9. The apparatus according to claim 8, wherein the at least one massage attachment is stationary.

10. The apparatus according to claim 8, wherein the at least one massage attachment is manually rotatable.

11. The apparatus according to claim 10, further including a motor disposed on an underside of the bath chamber and an output shaft rotatably driven by the motor, wherein the at least one massage attachment is adapted to be operably connected to the output shaft to provide motorized rotation of the massage attachment.

12. The apparatus according to claim 11, wherein motorized rotation of the at least one massage attachment is activated by pressure of the body part on the massage attachment.

13. The apparatus according to claim 5, wherein the bath chamber is generally U-shaped, and the contact area is generally peninsular and centrally disposed within the bath chamber.

14. The apparatus according to claim 1, further including a heater in communication with the bath chamber for maintaining the heat of the fluid contained therein.

15. The apparatus according to claim 14, wherein the heater includes a rope heating element provided underneath the bottom surface of the bath chamber.

16. The apparatus according to claim 1, further including a vibration assembly in communication with the bath chamber for imparting vibration to the bath chamber.

17. The apparatus according to claim 16, wherein the vibration assembly includes a motor affixed to an underside of the bath chamber, an output shaft rotatably driven by the motor, and a counterweight affixed to the output shaft.

18. The apparatus according to claim 1, further including a plurality of raised nodes provided on the bottom surface of the bath chamber.

19. The apparatus according to claim 1, wherein the bottom surface of the bath chamber includes rollers provided thereon.

20. The apparatus according to claim 19, wherein the rollers are detachable from the bottom surface of the bath chamber.

21. The apparatus according to claim 1, further including a lid adapted to be attached to the wall structure to at least partially cover the bath chamber.

22. The apparatus according to claim 1, further comprising an outer housing which encases the bath chamber.

23. A foot bath, comprising:

a bath chamber for containing water and receiving at least one foot therein, the bath chamber including a bottom surface and a wall structure extending upwardly therefrom;

a pump disposed adjacent to the bottom surface of the bath chamber; and at least one bubble egress tube in communication with the pump and the bath chamber bottom surface, the at least one bubble egress tube having a configuration including at least one reverse curve and including a plurality of egress holes formed therein through which air from the pump is directed into the bath chamber in order to generate air bubbles in the fluid contained therein.

24. A foot bath, comprising:

a bath chamber for containing water and receiving at least one foot therein, the bath chamber including a bottom surface, a wall structure extending upwardly from the bottom surface, and a contact area;

a heating member provided on the contact area, the heating member arranged to be uncovered by water contained in the bath chamber for providing heat to the foot when the foot is placed on the contact area;

a pump in communication with the bottom surface of the bath chamber; and at least one bubble egress tube in communication with the pump and the bath chamber bottom surface, the at least one bubble egress tube having a configuration including at least one generally S-shaped segment and including a plurality of egress holes formed therein through which air from the pump is directed into the bath chamber in order to generate air bubbles in the water contained therein.

25. A foot bath, comprising:

a bath chamber for containing water and receiving at least one foot therein, the bath chamber including a bottom surface and a wall structure extending upwardly therefrom, the bottom surface having a first side and a second side;

a pump disposed adjacent to the bottom surface of the bath chamber; and first and second bubble egress tubes disposed within the first and second sides of the bottom surface, respectively, and in communication with the pump and the bottom surface, each bubble egress tube having a generally serpentine configuration and including a plurality of egress holes formed therein through which air from the pump is directed into the bath chamber in order to generate air bubbles in the fluid contained therein.

26. The foot bath according to claim 25, wherein the bubble egress tubes are disposed below the bath chamber bottom surface such that the egress holes are flush with the bottom surface.

27. The foot bath according to claim 25, wherein the bubble egress tubes protrude at least partially above the bath chamber bottom surface such that the egress holes are raised above the bottom surface.

28. The foot bath according to claim 27, wherein the plurality of bubble egress holes are positioned at multiple axial locations along the egress tube.

29. The foot bath according to claim 23, wherein the bath chamber is generally U-shaped, and the wall structure includes a contact area adapted to be uncovered by fluid contained in the bath chamber.

30. The foot bath according to claim 29, further including an infrared heating member provided on the contact area for providing heat to the body part when the body part is placed on the contact area.

31. The foot bath according to claim 29, further including at least one massage attachment adapted to be received on the contact area for massaging the body part when the body part engages the massage attachment.

32. The foot bath according to claim 31, wherein the at least one massage attachment is stationary.

33. The foot bath according to claim 31, wherein the at least one massage attachment is rotatable.

34. The foot bath according to claim 33, wherein rotation of the at least one massage attachment is motorized and activated by pressure of the foot on the massage attachment.

35. The foot bath according to claim 25, further including a heater in communication with the bath chamber for maintaining the heat of the fluid contained therein.

36. The foot bath according to claim 25, further including a vibration assembly in communication with the bath chamber for imparting vibration to the bath chamber.

37. The foot bath according to claim 25, further including a plurality of raised nodes provided on the bottom surface of the bath chamber.

38. The foot bath according to claim 25, wherein the bottom surface of the bath chamber includes detachable rollers provided thereon.

39. The foot bath according to claim 25, further including a lid adapted to be attached to the wall structure to at least partially cover the bath chamber.

40. A foot bath, comprising:

a bath chamber for containing water and receiving at least one foot therein, the bath chamber including a bottom surface and a wall structure extending upwardly therefrom, the bottom surface having a first side and a second side;

a pump in communication with the bottom surface of the bath chamber; and first and second bubble egress tubes disposed within the first and second sides of the bottom surface, respectively, and in communication with the pump and the bath chamber bottom surface, the first and second bubble egress tubes each having a configuration formed by a plurality of connected linear segments which include a plurality of egress holes formed therein through which air from the pump is directed into the bath chamber in order to generate air bubbles in the fluid contained therein.

41. The foot bath according to claim 40, wherein each bubble egress tube has a sawtooth configuration.

42. The foot bath according to claim 40, wherein each bubble egress tube has a square-wave configuration.

* * * * *

UNITED STATES PATENT AND TRADEMARK OFFICE

CERTIFICATE OF CORRECTION

PATENT NO. : 6,725,471 B2
DATED : April 27, 2004
INVENTOR(S) : Roman S. Ferber et al.

It is certified that error appears in the above-identified patent and that said Letters Patent is hereby corrected as shown below:

Column 9,
Line 8, delete “baffling” and insert -- bathing --.

Column 11,
Line 19, delete “23” and insert -- 25 --.

Signed and Sealed this

Thirteenth Day of July, 2004

JON W. DUDAS
*Acting Director of the United States Patent and Trademark Office*